US007984759B2

(12) United States Patent
Ayasse

(10) Patent No.: US 7,984,759 B2
(45) Date of Patent: Jul. 26, 2011

(54) DILUENT-ENHANCED IN-SITU COMBUSTION HYDROCARBON RECOVERY PROCESS

(75) Inventor: Conrad Ayasse, Calgary (CA)

(73) Assignee: Archon Technologies Ltd., Calgary (CA)

( * ) Notice: Subject to any disclaimer, the term of this patent is extended or adjusted under 35 U.S.C. 154(b) by 84 days.

(21) Appl. No.: 12/280,832

(22) PCT Filed: Feb. 27, 2007

(86) PCT No.: PCT/CA2007/000312

§ 371 (c)(1),
(2), (4) Date: Jan. 29, 2009

(87) PCT Pub. No.: WO2007/095764

PCT Pub. Date: Aug. 30, 2007

(65) Prior Publication Data

US 2009/0308606 A1 Dec. 17, 2009

Related U.S. Application Data

(60) Provisional application No. 60/777,752, filed on Feb. 27, 2006.

(51) Int. Cl.
*E21B 43/243* (2006.01)

(52) U.S. Cl. ..... 166/261; 166/269; 166/272.1; 166/273.3; 166/272.6; 166/272.7

(58) Field of Classification Search ..... None
See application file for complete search history.

(56) References Cited

U.S. PATENT DOCUMENTS

| | | | | |
|---|---|---|---|---|
| 3,502,372 | A * | 3/1970 | Prats | 299/5 |
| 3,565,174 | A * | 2/1971 | Parker et al. | 166/261 |
| 4,415,031 | A | 11/1983 | Hunt | |
| 4,436,153 | A * | 3/1984 | Carlson | 166/260 |
| 4,566,537 | A * | 1/1986 | Gussis | 166/261 |
| 4,598,770 | A * | 7/1986 | Shu et al. | 166/245 |
| 5,145,003 | A * | 9/1992 | Duerksen | 166/272.3 |
| 5,217,076 | A * | 6/1993 | Masek | 166/303 |
| 5,339,897 | A * | 8/1994 | Leaute | 166/245 |
| 5,626,191 | A | 5/1997 | Greaves et al. | |
| 6,412,557 | B1 | 7/2002 | Ayasse et al. | |
| 7,464,756 | B2 * | 12/2008 | Gates et al. | 166/272.3 |
| 7,493,952 | B2 * | 2/2009 | Ayasse | 166/261 |
| 7,493,953 | B2 * | 2/2009 | Ayasse | 166/261 |
| 7,581,587 | B2 * | 9/2009 | Pfefferle | 166/245 |

FOREIGN PATENT DOCUMENTS

| | | | |
|---|---|---|---|
| CA | 1197455 | A1 | 12/1985 |
| CA | 2176639 | A1 | 12/1996 |
| WO | 2005121504 | A1 | 12/2005 |

OTHER PUBLICATIONS

International Search Report for corresponding International Patent Application No. PCT/CA2007/000312, mailed May 17, 2007.

* cited by examiner

*Primary Examiner* — George Suchfield
(74) *Attorney, Agent, or Firm* — Locke Lord Bissell & Liddell LLP

(57) ABSTRACT

A modified process for recovering oil from an underground reservoir using the toe-to-heel in situ combustion process. A diluent, namely a hydrocarbon condensate, is injected within a horizontal wellbore portion, preferably proximate the toe, of a vertical-horizontal well pair, or alternatively into an adjacent injection well, or both, to increase mobility of oil.

20 Claims, 6 Drawing Sheets

Figure 2. Reservoir Dimensions and Placement of Wells

DILUENT-ENHANCED IN-SITU COMBUSTION HYDROCARBON RECOVERY PROCESS

CROSS REFERENCE TO RELATED APPLICATIONS

This application is a National Stage application under 35 U.S.C. §371 of International Application No. PCT/CA2007/000312, filed Feb. 27, 2007, which claims the benefit of U.S. Provisional Patent Application No. 60/777,752, filed Feb. 27, 2006.

FIELD OF THE INVENTION

This invention relates to a process for improved productivity when undertaking oil recovery from an underground reservoir by the toe-to-heel in situ combustion process employing a horizontal production well, such as disclosed in U.S. Pat. Nos. 5,626,191 and 6,412,557. More particularly, it relates to an in situ combustion process in which a diluent, namely, a hydrocarbon condensate, is injected in the horizontal leg of a vertical-horizontal well pair adapted for use in an in situ combustion process.

BACKGROUND OF THE INVENTION AND DESCRIPTION OF THE PRIOR ART

U.S. Pat. Nos. 5,626,191 and 6,412,557, incorporated herein in their entirety, disclose in situ combustion processes for producing oil from an underground reservoir (100) utilizing an injection well (102) placed relatively high in an oil reservoir (100) and a production well (103-106) completed relatively low in the reservoir (100). The production well has a horizontal leg (107) oriented generally perpendicularly to a generally linear and laterally extending upright combustion front propagated from the injection well (102). The leg (107) is positioned in the path of the advancing combustion front. Air, or other oxidizing gas, such as oxygen-enriched air, is injected through wells 102, which may be vertical wells, horizontal wells or combinations of such wells.

The process of U.S. Pat. No. 5,626,191 is called "THAI™", an acronym for "toe-to-heel air injection" and the process of U.S. Pat. No. 6,412,557 is called "Capri™", the Trademarks being held by Archon Technologies Ltd., a subsidiary of Petrobank Energy and Resources Ltd., Calgary, Alberta, Canada.

What is needed is one or more methods to increase productivity when undertaking oil recovery from an underground reservoir by the toe-to-heel in situ combustion process employing horizontal production wells.

SUMMARY OF THE INVENTION

The invention, in a broad embodiment, comprises injecting a diluent in the form of a hydrocarbon condensate via tubing at the toe of the toe-to-heel in situ combustion process employed a horizontal production well, which adds to well productivity and advantageously results in various production economies over the THAI and CAPRI processes to date employed.

A hydrocarbon condensate is typically a low-density, high-API gravity liquid hydrocarbon phase that generally occurs in association with natural gas. Its presence as a liquid phase depends on temperature and pressure conditions in the reservoir allowing condensation of liquid from vapor.

The production of condensate from reservoirs can be complicated because of the pressure sensitivity of some condensates. Specifically, during production, there is a risk of the condensate changing from gas to liquid if the reservoir pressure (and thus temperature) drops below the dew point during production. Reservoir pressure (and thus temperature) can be maintained by fluid injection if gas production is preferable to liquid production. Gas produced in association with condensate is called wet gas. The API gravity of condensate is typically 50 degrees to 120 degrees.

The benefit of injection a high-API hydrocarbon condensate (40+ API Gravity) into the tubing in a THAI™ or CAPRI™ in situ hydrocarbon extraction method is that a steam generator or water treatment facilities, as are typically required in THAI™ and CAPRI™ in situ hydrocarbon extraction methods, would not be required. This results in a significant expense savings, not only in avoiding the cost of having to divert a portion of the produced hydrocarbon to produce heated steam, but also in having to have the necessary steam generation equipment and pollution control equipment present to do so. Process operations costs would not be increased since the diluent in liquid form is purchased anyway, and typically in prior art methods involving THAI and CAPRI, mixed with the extracted hydrocarbon at the surface in order to better pump the hydrocarbon to storage facilities or refineries.

The diluent would dissolve in the liquid oil in the horizontal wellbore and reduce its viscosity, which would advantageously reduce pressure drop in the horizontal well. It would also reduce the density of the oil, facilitating its rise to the surface by gas-lift.

The addition of a diluent in the form of a hydrocarbon condensate, preferably a liquid, via tubing at the toe of a horizontal production well in a toe-to-heel in situ combustion hydrocarbon recovery process, may be done in combination with any of the steam, water, or oxidizing gas injection methods disclosed in Patent Cooperation Patent Application PCT/CA2005/000883 filed Jun. 6, 2005, and published as WO2005/121504 on Dec. 22, 2005, which is hereby incorporated herein by reference in its entirety.

Accordingly, in one broad embodiment of the method of the present invention, the invention comprises a process for extracting liquid hydrocarbons from an underground reservoir comprising the steps of:

(a) providing at least one injection well for injecting an oxidizing gas into the underground reservoir;
(b) providing at least one production well having a substantially horizontal leg and a substantially vertical production well connected thereto, the horizontal leg having a heel portion in the vicinity of its connection to the vertical production well and a toe portion at the opposite end of the horizontal leg;
(c) injecting an oxidizing gas through the injection well to conduct in situ combustion, so that combustion gases are produced so as to cause the combustion gases to progressively advance as a front, substantially perpendicular to the horizontal leg, and fluids drain into the horizontal leg;
(d) providing a tubing inside the production well for the purpose of injecting a hydrocarbon condensate into said horizontal leg portion of said production well;
(e) injecting said hydrocarbon condensate into said tubing so that said condensate is conveyed proximate said toe portion of said horizontal leg portion via said tubing; and
(f) recovering hydrocarbons in the horizontal leg of the production well from said production well.

In a further broad embodiment of the invention, the present invention comprises a process for extracting liquid hydrocarbons from an underground reservoir, comprising the steps of:

(a) providing at least one injection well for injecting an oxidizing gas into an upper part of an underground reservoir;

(b) providing at least one injection well for injecting a hydrocarbon condensate diluent into a lower part of an underground reservoir;

(c) providing at least one production well having a substantially horizontal leg and a substantially vertical production well connected thereto, wherein the substantially horizontal leg extends toward the injection well, the horizontal leg having a heel portion in the vicinity of its connection to the vertical production well and a toe portion at the opposite end of the horizontal leg;

(d) injecting an oxidizing gas through the injection well for in situ combustion, so that combustion gases are produced, wherein the combustion gases progressively advance as a front, substantially perpendicular to the horizontal leg, in the direction of the horizontal leg, and fluids drain into the horizontal leg;

(e) injecting a hydrocarbon condensate diluent, into said injection well; and (f) recovering hydrocarbons in the horizontal leg of the production well from said production well.

In a still further embodiment of the invention, the present invention comprises the combination of the above steps of injecting a hydrocarbon diluent to the formation via the injection well, and as well injecting a medium via tubing in the horizontal leg. Accordingly, in this further embodiment, the present invention comprises a method for extracting liquid hydrocarbons from an underground reservoir, comprising the steps of:

a) providing at least one injection well for injecting an oxidizing gas into an upper part of an underground reservoir;

b) providing at least one injection well for a hydrocarbon diluent into a lower part of an underground reservoir;

c) providing at least one production well having a substantially horizontal leg and a substantially vertical production well connected thereto, the horizontal leg having a heel portion in the vicinity of its connection to the vertical production well and a toe portion at the opposite end of the horizontal leg;

d) providing a tubing inside the production well for the purpose of injecting a hydrocarbon condensate diluent into said horizontal leg portion of said production well;

e) injecting an oxidizing gas through the injection well for in situ combustion, so that combustion gases are produced, wherein the combustion gases progressively advance as a front, substantially perpendicular to the horizontal leg, in the direction of the horizontal leg, and fluids drain into the horizontal leg;

f) injecting a hydrocarbon condensate diluent into said injection well and into said tubing; and (g) recovering hydrocarbons in the horizontal leg of the production well from said production well.

The hydrocarbon condensate contemplated is preferably a condensate selected from the group of condensates consisting of ethane, butanes, pentanes, heptanes, hexanes, octanes, and higher molecular weight hydrocarbons, or mixtures thereof, but may be any other hydrocarbon diluent, such as volatile hydrocarbons such as naphtha or gasoline, or VAPEX (a term of art referring to a hydrocarbon solvent used in a vapour extraction process, such as propane or butane or mixtures thereof).

Item A represents the top level of a heavy oil or bitumen reservoir, and B represents the bottom level of such reservoir/formation. C represents a vertical well with D showing the general injection point of a oxidizing gas such as air.

E represents one general location for the injection of hydrocarbon condensate into the reservoir. This is part of the present invention.

F represents a partially perforated horizontal well casing. Fluids enter the casing and are typically conveyed directly to the surface by natural gas lift through another tubing located at the heel of the horizontal well (not shown).

G represents a tubing placed inside the horizontal leg. The open end of the tubing may be located near the end of the casing, as represented, or elsewhere. The tubing can be 'coiled tubing' that may be easily relocated inside the casing. This is part of the present invention.

The elements E and G are part of the present invention and steam or non-oxidizing gas may be injected at E and/or at G. E may be part of a separate well or may be part of the same well used to inject the oxidizing gas. These injection wells may be vertical, slanted or horizontal wells or otherwise and each may serve several horizontal wells.

For example, using an array of parallel horizontal leg as described in U.S. Pat. Nos. 5,626,191 and 6,412,557, the steam, water or non-oxidizing gas may be injected at any position between the horizontal legs in the vicinity of the toe of the horizontal legs.

Figure 2:
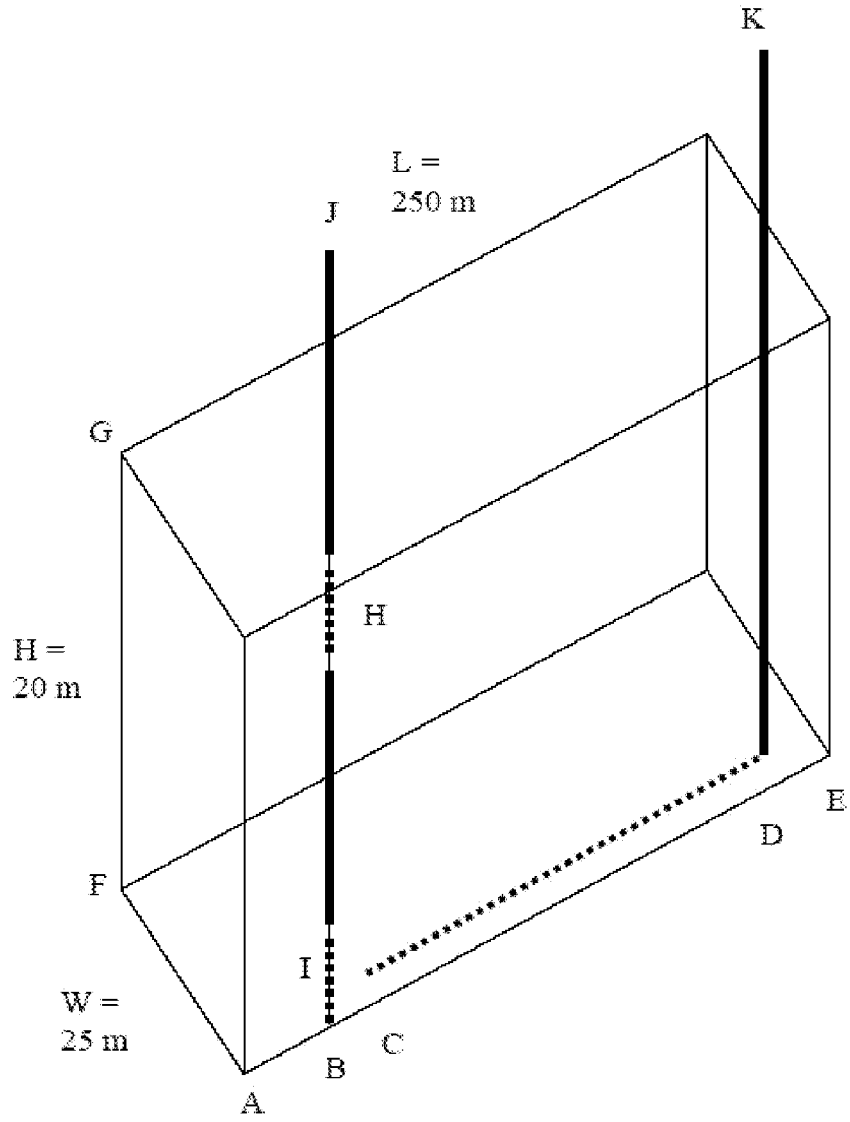

FIG. 2 is a schematic diagram of the Model reservoir. The schematic is not to scale. Only an "element of symmetry" is shown. The full spacing between horizontal legs is 50 meters but only the half-reservoir needs to be defined in the STARS™ computer software. This saves computing time.

The overall dimensions of the Element of Symmetry are: length A-E is 250 m; width A-F is 25 m; and height F-G is 20 m.

The positions of the wells, with reference to FIG. 2, are as follows:

Oxidizing gas injection well J is placed at B in the first grid block 50 meters (A-B) from a corner A. The toe of the horizontal well K is in the first grid block between A and F and is 15 m (B-C) offset along the reservoir length from the injector well J. The heel of the horizontal well K lies at D and is 50 m from the corner of the reservoir, E. The horizontal section of the horizontal well K is 135 m (C-D) in length and is placed 2.5 m above the base of the reservoir (A-E) in the third grid block.

The Injector well J is perforated in two (2) locations. The perforations at H are injection points for oxidizing gas, while the perforations at I are injection points for steam or non-oxidizing gas. The horizontal leg (C-D) is perforated 50% and contains tubing open near the toe (not shown, see FIG. 1).

Figure 3:
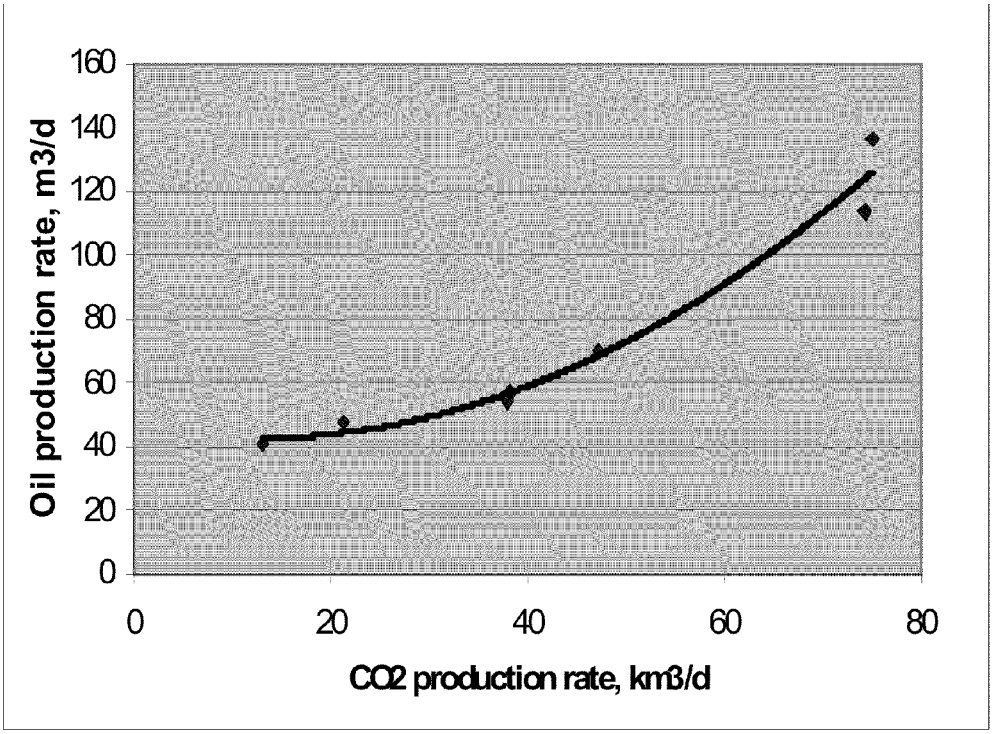
Figure 4:
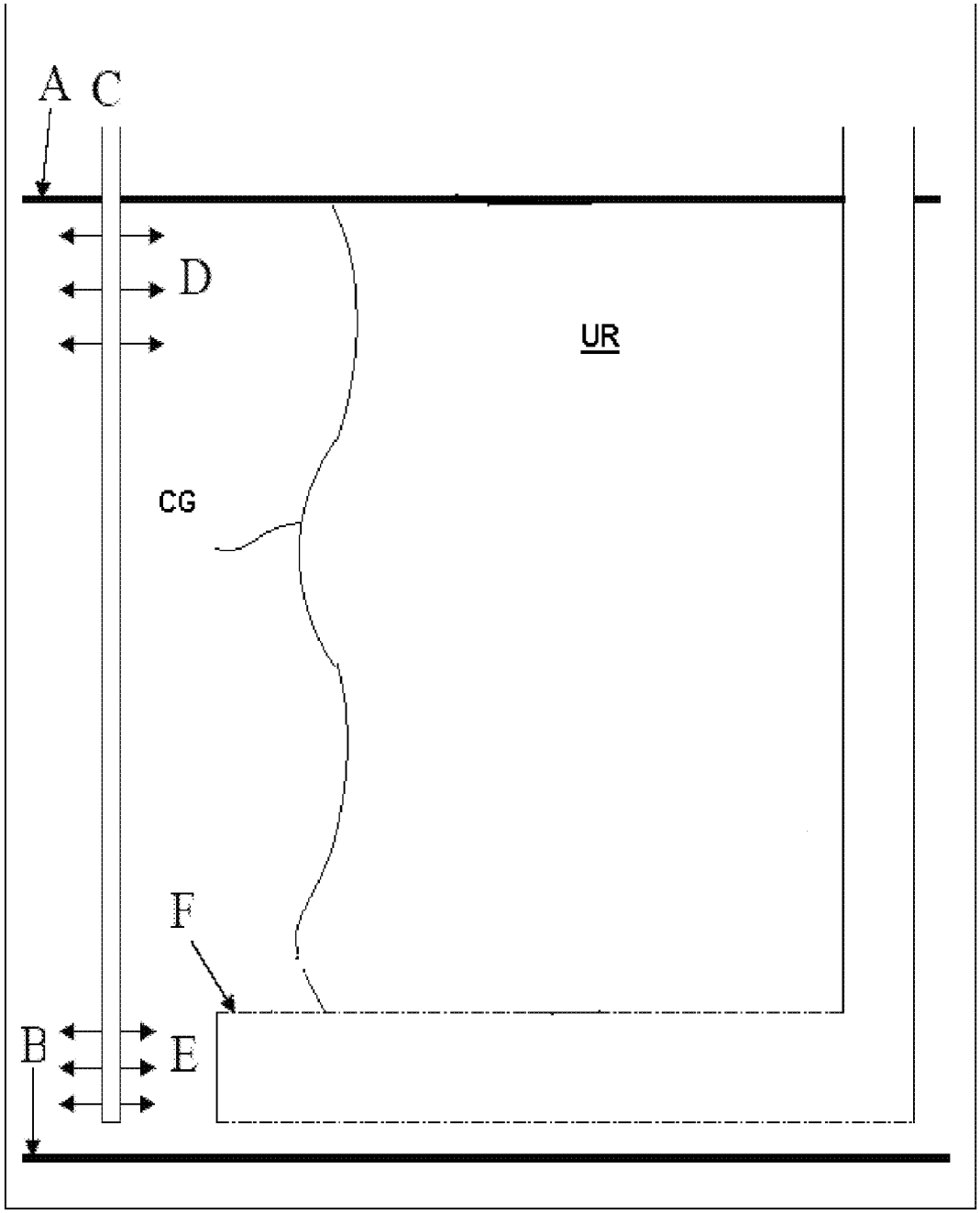
Figure 5:
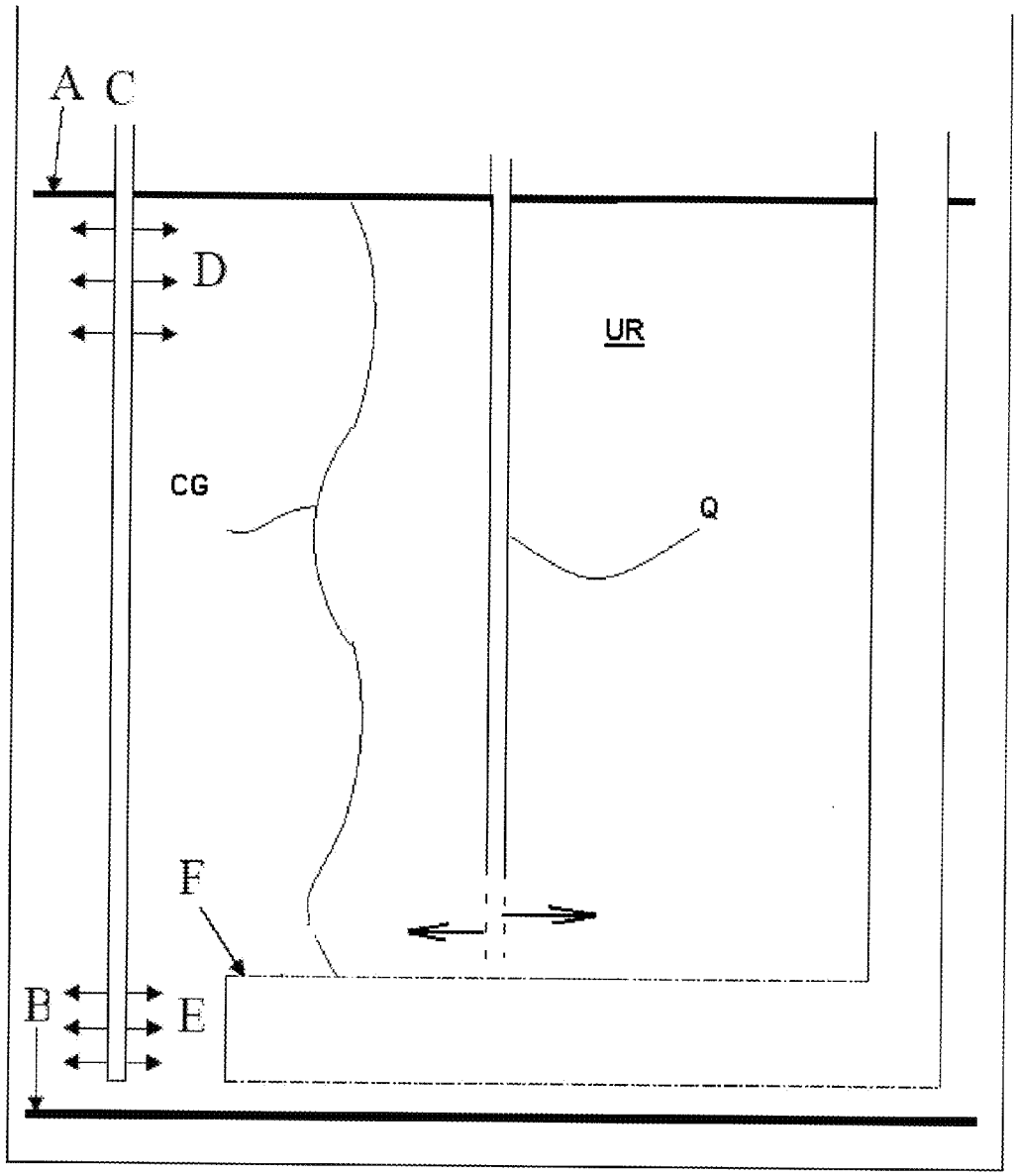
Figure 6:
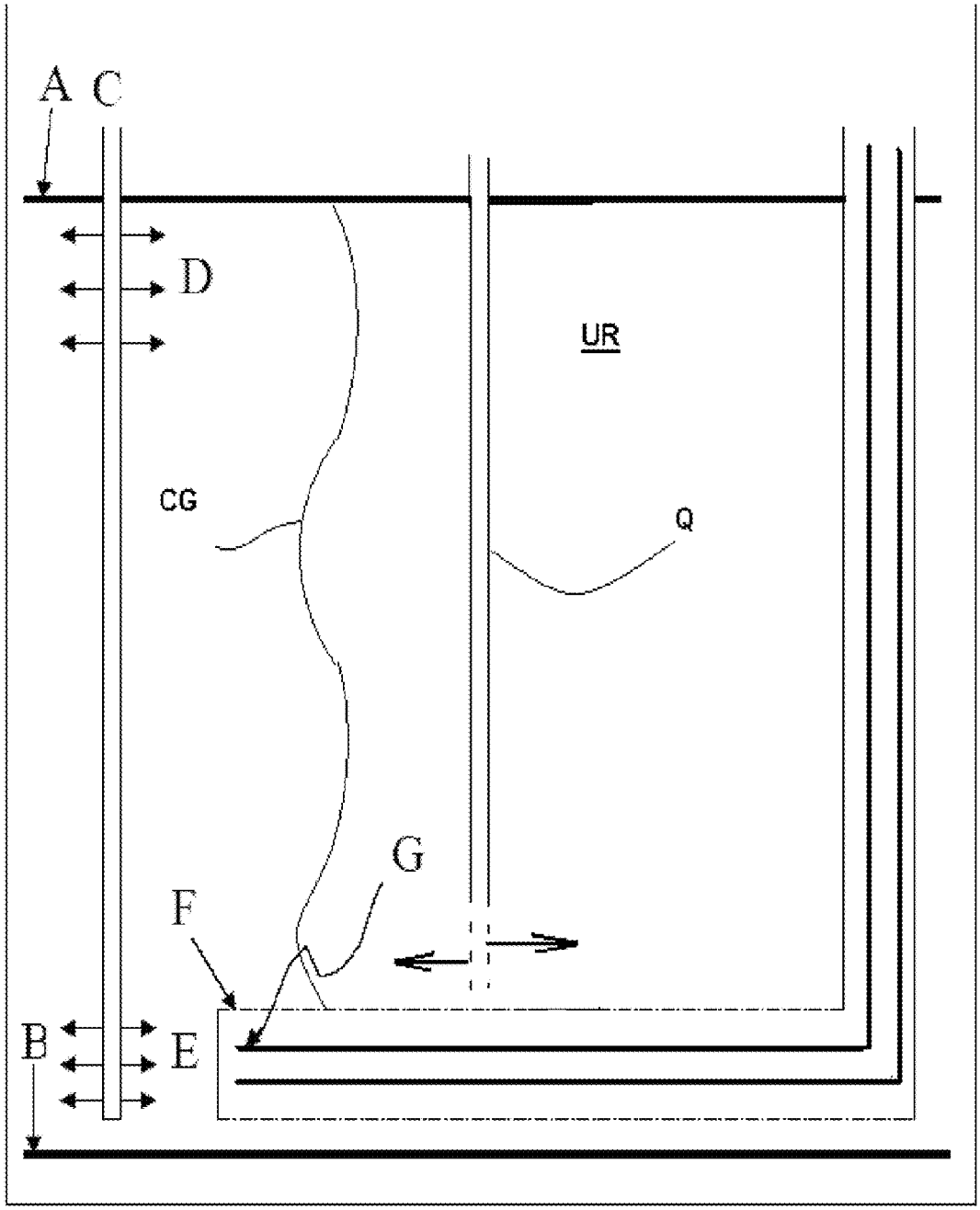

FIG. 3 is a graph plotting oil production rate vs. $CO_2$ rate of injection in the reservoir, drawing on Example 7 discussed below;

FIG. 4 is a schematic view of the further embodiment of the process of the present invention, without tubing in the production well, showing the injection of hydrocarbon diluent/condensate low in the reservoir via a lower part of the oxidizing gas injection well;

FIG. 5 is a schematic view of the further embodiment of the process of the present invention, showing provision of separate injection well, in addition to the oxidizing gas injection well, for injection of a hydrocarbon condensate low in the reservoir; and FIG. 6 is a schematic view of the further embodiment of the process of the present invention, showing provision of separate injection well, in addition to the oxidizing gas injection well, for injection of a hydrocarbon condensate low in the reservoir, and showing tubing within the horizontal leg of the production well for additional injection of hydrocarbon diluent/condensate into the horizontal leg.

DESCRIPTION OF THE PREFERRED EMBODIMENTS

The operation of the THAI™ process has been described in U.S. Pat. Nos. 5,626,191 and 6,412,557 and will be briefly reviewed. The oxidizing gas, typically air, oxygen or oxygen-enriched air, is injected into the upper part of the reservoir. Coke that was previously laid down consumes the oxygen so that only oxygen-free gases contact the oil ahead of the coke zone. Combustion gas temperatures of typically 600° C. and as high as 1000° C. are achieved from the high-temperature oxidation of the coke fuel. In the Mobile Oil Zone (MOZ), these hot gases and steam heat the oil to over 400° C., partially cracking the oil, vaporizing some components and greatly reducing the oil viscosity. The heaviest components of the oil, such as asphaltenes, remain on the rock and will constitute the coke fuel later when the burning front arrives at that location. In the MOZ, gases and oil drain downward into the horizontal well, drawn by gravity and by the low-pressure sink of the well. The coke and MOZ zones move laterally from the direction from the toe towards the heel of the horizontal well. The section behind the combustion front is labeled the Burned Region. Ahead of the MOZ is cold oil.

With the advancement of the combustion front, the Burned Zone of the reservoir is depleted of liquids (oil and water) and is filled with oxidizing gas. The section of the horizontal well opposite this Burned Zone is in jeopardy of receiving oxygen which will combust the oil present inside the well and create extremely high wellbore temperatures that would damage the steel casing and especially the sand screens that are used to permit the entry of fluids but exclude sand. If the sand screens fail, unconsolidated reservoir sand will enter the wellbore and necessitate shutting in the well for cleaning-out and remediation with cement plugs. This operation is very difficult and dangerous since the wellbore can contain explosive levels of oil and oxygen.

Reference is to be had to the drawings in regard to the invention described in the Summary of the Invention.

Figure 1:
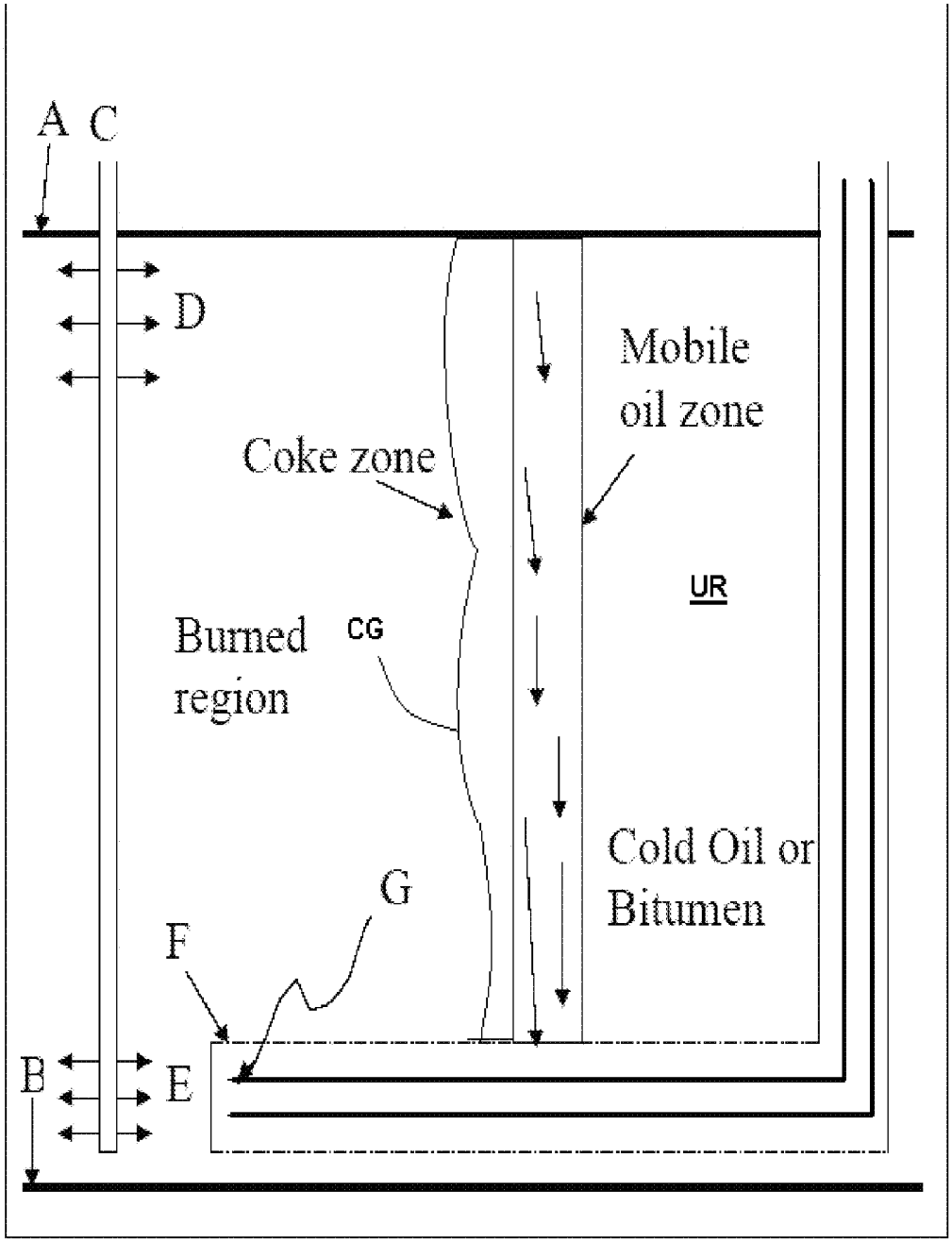
FIG. 1 is a schematic of one embodiment of the in situ combustion process of the present invention with labeling as follows.

Specifically, in the first broad embodiment of the process of the present invention for extracting liquid hydrocarbons from an underground reservoir set out in the Summary of the Invention and depicted in and with reference to FIG. 1, such process comprises the steps of:

(a) providing at least one injection well C for injecting an oxidizing gas at location D into the underground reservoir UR;

(b) providing at least one production well having a substantially horizontal perforated well casing (horizontal leg) F and a substantially vertical production well connected thereto, the horizontal leg F having a heel portion in the vicinity of its connection to the vertical production well and a toe portion at the opposite end of the horizontal leg F;

(c) injecting an oxidizing gas through the injection well relatively high in the formation at location D to conduct in situ combustion, so that combustion gases CG are produced so as to cause the combustion gases CG to progressively advance as a front, substantially perpendicular to the horizontal leg F and in the direction of the horizontal leg F, and fluids drain into the horizontal leg;

(d) providing a tubing G inside the production well for the purpose of injecting a hydrocarbon condensate into said horizontal leg portion F of said production well;

(e) injecting said hydrocarbon condensate into said tubing G so that said condensate is conveyed into said horizontal leg portion F; and (f) recovering hydrocarbons in the horizontal leg F of the production well from said production well.

In a further embodiment of the process of the present invention for extracting liquid hydrocarbons from an underground reservoir UR comprises injecting such hydrocarbon condensate into an injection well Q separate from the oxidizing gas injection well, as depicted in (and with reference to) FIG. 4, such process comprises the steps of:

(a) providing at least one injection well C for injecting an oxidizing gas into an upper part (ie at location D) of an underground reservoir UR;

(b) utilizing said at least one injection well C for injecting a hydrocarbon condensate diluent into a lower part of an underground reservoir at location E;

(c) providing at least one production well having a substantially horizontal leg F and a substantially vertical production well connected thereto, the horizontal leg having a heel portion in the vicinity of its connection to the vertical production well and a toe portion at the opposite end of the horizontal leg;

(d) injecting an oxidizing gas through the injection well C for in situ combustion, so that combustion gases CG are produced, wherein the combustion gases CG progressively advance as a front, substantially perpendicular to the horizontal leg F and in the direction of the horizontal leg F and fluids drain into the horizontal leg;

(e) injecting a hydrocarbon condensate diluent into said injection well Q; and (f) recovering hydrocarbons in the horizontal leg F of the production well from said production well.

In a further embodiment of the process of the present invention for extracting liquid hydrocarbons from an underground reservoir UR comprises injecting such hydrocarbon condensate into injection well Q, wherein such injection well Q is separate from the oxidizing gas injection well C, as depicted in (and with reference to) FIG. 5, such process comprising the steps of:

(a) providing at least one injection well C for injecting an oxidizing gas into an upper part of an underground reservoir UR at location D;

(b) providing another injection well Q for injecting a hydrocarbon condensate diluent into a lower part of an underground reservoir;

(c) providing at least one production well having a substantially horizontal leg F and a substantially vertical production well connected thereto, the horizontal leg F having a heel portion in the vicinity of its connection to the vertical production well and a toe portion at the opposite end of the horizontal leg;

(d) injecting an oxidizing gas through the injection well C for in situ combustion, so that combustion gases CG are produced, wherein the combustion gases CG progressively advance as a front, substantially perpendicular to the horizontal leg, in the direction of the horizontal leg F, and fluids drain into the horizontal leg;

(e) injecting a hydrocarbon condensate diluent into said injection well Q; and (f) recovering hydrocarbons in the horizontal leg of the production well from said production well.

In a still further embodiment of the invention, the present invention comprises the combination of the above steps of injecting a hydrocarbon diluent to the underground reservoir UR via the separate injection well Q, and as well injecting a medium via tubing G in the horizontal leg F. Accordingly, in this further embodiment, the present invention depicted and as shown in FIG. 6 comprises the steps of:

a) providing at least one injection well C for injecting an oxidizing gas into an upper part of an underground reservoir UR at location D;

b) providing at least one other injection well Q for injecting a hydrocarbon diluent into a lower part of an underground reservoir;

c) providing at least one production well having a substantially horizontal leg F and a substantially vertical production well connected thereto, wherein the substantially horizontal leg extends toward the injection well, the horizontal leg F having a heel portion in the vicinity of its connection to the vertical production well and a toe portion at the opposite end of the horizontal leg F;

d) providing a tubing G inside the production well for the purpose of injecting a hydrocarbon condensate diluent into said horizontal leg F of said production well;

e) injecting an oxidizing gas through the injection well C for in situ combustion, so that combustion gases CG are produced, wherein the combustion gases CG progressively advance as a front, substantially perpendicular to the horizontal leg, in a direction of said horizontal leg F, and fluids drain into the horizontal leg F;

f) injecting a hydrocarbon condensate diluent into said injection well Q and into said tubing G; and (g) recovering hydrocarbons in the horizontal leg F of the production well from said production well.

In order to quantify the effect of fluid injection into the horizontal leg F wellbore, a number of computer numerical simulations of the process were conducted. Steam was injected at a variety of rates into the horizontal well by two methods: 1. via tubing placed inside the horizontal well, and 2. via a separate well extending near the base of the reservoir in the vicinity of the toe of the horizontal well. Both of these methods reduced the predilection of oxygen to enter the wellbore but gave surprising and counterintuitive benefits: the oil recovery factor increased and build-up of coke in the wellbore decreased. Consequently, higher oxidizing gas injection rates could be used while maintaining safe operation.

It was found that both methods of adding steam to the reservoir provided advantages regarding the safety of the THAI™ Process by reducing the tendency of oxygen to enter the horizontal wellbore. It also enabled higher oxidizing gas injection rates into the reservoir, and higher oil recovery.

Extensive computer simulation of the THAI™ Process was undertaken to evaluate the consequences of reducing the pressure in the horizontal wellbore by injecting steam or non-oxidizing gas. The software was the STARS™ In Situ Combustion Simulator provided by the Computer Modelling Group, Calgary, Alberta, Canada.

Table 4. List of Model Parameters.

Simulator: STARS™ 2003.13, Computer Modelling Group Limited

Model Dimensions:

Length 250 m, 100 grid blocks, each

Width 25 m, 20 grid blocks

Height 20 m, 20 grid blocks

Grid Block dimensions: 2.5 m×2.5 m×1.0 m (LWH).

Horizontal Production Well:

A discrete well with a 135 m horizontal section extending from grid block 26, 1, 3 to 80, 1, 3

The toe is offset by 15 m from the vertical air injector.

Vertical Injection Well:

Oxidizing gas (air) injection points: 20, 1, 1:4 (upper 4-grid blocks)

Oxidizing gas injection rates: 65,000 $m^3$/d, 85,000 $m^3$/d or 100,000 $m^3$/d Steam injection points: 20, 1, 19:20 (lower 2-grid blocks)

Rock/Fluid Parameters:

Components: water, bitumen, upgrade, methane, CO2, CO/N2, oxygen, coke

Heterogeneity: Homogeneous sand.

Permeability: 6.7 D (h), 3.4 D (v)

Porosity: 33%

Saturations: Bitumen 80%, water 20%, gas Mole fraction 0.114

Bitumen viscosity: 340,000 cP at 10° C.

Bitumen average molecular weight: 550 AMU

Upgrade viscosity: 664 cP at 10° C.

Upgrade average molecular weight: 330 AMU

Physical Conditions:

Reservoir temperature: 20° C.

Native reservoir pressure: 2600 kPa.

Bottomhole pressure: 4000 kPa.

Reactions:

1. 1.0 Bitumen>0.42 Upgrade+1.3375 CH4+20 Coke 2. 1.0 Bitumen+16 O2^0.05>12.5 water+5.0 CH4+9.5 CO2+0.5 CO/N2+15 Coke 3. 1.0 Coke+1.225 02>0.5 water+0.95 CO2+0.05 CO/N2

EXAMPLES

Example 1

Table 1a shows the simulation results for an air injection rate of 65,000 $m^3$/day (standard temperature and pressure) into a vertical injector (E in FIG. 1). The case of zero steam injected at the base of the reservoir at point in well J is not part of the present invention. At 65,000 $m^3$/day air rate, there is no oxygen entry into the horizontal wellbore even with no steam injection and the maximum wellbore temperature never exceeds the target of 425° C.

However, as may be seen from the data below, injection of low levels of steam at levels of 5 and 10 $m^3$/day (water equivalent) at a point low in the reservoir (E in FIG. 1) provides substantial benefits in higher oil recovery factors, contrary to intuitive expectations. Where the injected medium is steam, the data below provides the volume of the water equivalent of such steam, as it is difficult to otherwise determine the volume of steam supplied as such depends on the pressure at the formation to which the steam is subjected to. Of course, when water is injected into the formation and subsequently becomes steam during its travel to the formation, the amount of steam generated is simply the water equivalent given below, which typically is in the order of about 1000× (depending on the pressure) of the volume of the water supplied.

TABLE 1a

| AIR RATE 65,000 $m^3$/day- Steam injected at reservoir base. | | | | | |
|---|---|---|---|---|---|
| Steam Injection Rate $m^3$/day (water equivalent) | Maximum well Temperature, ° C. | Maximum coke in wellbore % | Maximum Oxygen in wellbore % | Bitumen recovery Factor % OOIP | Average oil Production Rate $m^3$/day |
| *0 | 410 | 90 | 0 | 35.1 | 28.3 |
| 5 | 407 | 79 | 0 | 38.0 | 29.0 |
| 10 | 380 | 76 | 0 | 43.1 | 29.8 |

*Not part of the present invention.

Example 2

Table 1b shows the results of injecting steam into the horizontal well via the internal tubing, G, in the vicinity of the toe while simultaneously injecting air at 65,000 $m^3$/day (standard temperature and pressure) into the upper part of the reservoir. The maximum wellbore temperature is reduced in relative proportion to the amount of steam injected and the oil recovery factor is increased relative to the base case of zero steam. Additionally, the maximum volume percent of coke deposited in the wellbore decreases with increasing amounts of injected steam. This is beneficial since pressure drop in the wellbore will be lower and fluids will flow more easily for the same pressure drop in comparison to wells without steam injection at the toe of the horizontal well.

TABLE 1b

| AIR RATE 65,000 $m^3$/day- Steam injected in well tubing. | | | | | |
|---|---|---|---|---|---|
| Steam Injection Rate $m^3$/day (water equivalent) | Maximum well Temperature, ° C. | Maximum coke in wellbore % | Maximum Oxygen in wellbore % | Bitumen recovery Factor % OOIP | Average oil Production Rate $m^3$/day |
| *0 | 410 | 90 | 0 | 35.1 | 28.6 |
| 5 | 366 | 80 | 0 | 43.4 | 30.0 |
| 10 | 360 | 45 | 0 | 43.4 | 29.8 |

*Not part of the present invention.

Example 3

In this example, the air injection rate was increased to 85,000 $m^3$/day (standard temperature and pressure) and resulted in oxygen breakthrough as shown in Table 2a. An 8.8% oxygen concentration was indicated in the wellbore for the base case of zero steam injection. Maximum wellbore temperature reached 1074° C. and coke was deposited decreasing wellbore permeability by 97%. Operating with the simultaneous injection of 12 $m^3$/day (water equivalent) of steam at the base of the reservoir via vertical injection well C (see FIG. 1) provided an excellent result of zero oxygen breakthrough, acceptable coke and good oil recovery.

TABLE 2a

| AIR RATE 85,000 $m^3$/day- Steam injected at reservoir base. | | | | | |
|---|---|---|---|---|---|
| Steam Injection Rate $m^3$/d (water equivalent) | Maximum well Temperature, ° C. | Maximum coke in wellbore % | Maximum Oxygen in wellbore % | Bitumen recovery Factor % OOIP | Average oil Production Rate $m^3$/day |
| *0 | 1074 | 97 | 8.8 | | |
| 5 | 518 | 80 | 0 | | |
| 12 | 414 | 43 | 0 | 36.1 | 33.4 |

*Not part of the present invention.

Example 4

Table 2b shows the combustion performance with 85,000 $m^3$/day air (standard temperature and pressure) and simultaneous injection of steam into the wellbore via an internal tubing G (see FIG. 1). Again 10 $m^3$/day (water equivalent) of steam was needed to prevent oxygen breakthrough and an acceptable maximum wellbore temperature.

TABLE 2b

AIR RATE 85,000 $m^3$/d. Steam injected in well tubing.

| Steam Injection Rate $m^3$/d (water equivalent) | Maximum well Temperature, ° C. | Maximum coke in wellbore % | Maximum Oxygen in wellbore % | Bitumen recovery Factor % OOIP | Average oil Production Rate $m^3$/day |
|---|---|---|---|---|---|
| *0 | 1074 | 100 | 8.8 | | |
| 5 | 500 | 96 | 1.8 | | |
| 10 | 407 | 45 | 0 | 37.3 | 33.2 |

*Not part of the present invention.

Example 5

In order to further test the effects of high air injection rates, several runs were conducted with 100,000 $m^3$/day air injection. Results in Table 3a indicate that with simultaneous steam injection at the base of the reservoir (i.e., at location B-E in vertical well C—ref. FIG. 1), 20 $m^3$/day (water equivalent) of steam was required to stop oxygen breakthrough into the horizontal leg, in contrast to only 10 $m^3$/day steam (water equivalent) at an air injection rate of 85,000 $m^3$/day.

TABLE 3a

AIR RATE 100,000 $m^3$/day-Steam injected at reservoir base.

| Steam Injection Rate $m^3$/day (water equivalent) | Maximum well Temperature, ° C. | Maximum coke in wellbore % | Maximum Oxygen in wellbore % | Bitumen recovery Factor % OOIP | Average oil Production Rate $m^3$/day |
|---|---|---|---|---|---|
| *0 | 1398 | 100 | 10.4 | | |
| 5 | 1151 | 100 | 7.2 | | |
| 10 | 1071 | 100 | 6.0 | | |
| 20 | 425 | 78 | 0 | 34.5 | 35.6 |

*Not part of the present invention.

Example 6

Table 3b shows the consequence of injecting steam into the well tubing G (ref. FIG. 1) while injecting 100,000 $m^3$/day air into the reservoir. Identically with steam injection at the reservoir base, a steam rate of 20 $m^3$/day (water equivalent) was required in order to prevent oxygen entry into the horizontal leg.

TABLE 3b

AIR RATE 100,000 $m^3$/d. Steam injected in well tubing.

| Steam Injection Rate $m^3$/day (water equivalent) | Maximum well Temperature, ° C. | Maximum coke in wellbore % | Maximum Oxygen in wellbore % | Bitumen recovery Factor % OOIP | Average oil Production Rate $m^3$/day |
|---|---|---|---|---|---|
| *0 | 1398 | 100 | 10.4 | | |
| 5 | 997 | 100 | 6.0 | | |
| 10 | 745 | 100 | 3.8 | | |
| 20 | 425 | 38 | 0 | 33.9 | 35.6 |

Example 7

Table 4 below shows comparisons between injecting oxygen and a combination of non-oxidizing gases, namely nitrogen and carbon dioxide, into a single vertical injection well in combination with a horizontal production well in the THAI™ process via which the oil is produced, as obtained by the STARS™ In Situ Combustion Simulator software provided by the Computer Modelling Group, Calgary, Alberta, Canada. The computer model used for this example was identical to that employed for the above six examples, with the exception that the modeled reservoir was 100 meters wide and 500 meters long. Steam was added at a rate of 10 $m^3$/day via the tubing in the horizontal section of the production well for all runs.

TABLE 4

| Test | Injection Rate, $km^3$/day | | | Mol % Oxygen | Mol % CO2 | Total Injection Rate, | Production Rate, $km^3$/day | | Produced Gas Mol % | Oil Rate $m^3$/day | Cumulative Oil Recovery |
|---|---|---|---|---|---|---|---|---|---|---|---|
| # | O2 | CO2 | N2 | Injected | Injected | $km^3$/day | CO2 | N2 | CO2 | (1-year) | $m^3$ |
| 1 | 17.85 | 0 | 67.15 | 21 | 0 | 85 | 13.1 | 67.2 | 16.3 | 41 | 9700 |
| 2 | 8.93 | 33.57 | 0 | 21 | 79 | 42.5 | 37.9 | 0.0 | 96.0 | 54 | 12780 |
| 3 | 25 | 0 | 0 | 100 | 0 | 25 | 21.3 | 0.0 | 96.0 | 47 | 10078 |
| 4 | 17.85 | 67.15 | 0 | 21 | 79 | 85 | 75.0 | 0.0 | 96.0 | 136 | 20000 |
| 5 | 42.5 | 0 | 0 | 100 | 0 | 42.5 | 38.1 | 0.0 | 96.0 | 57 | 12704 |
| 6 | 42.5 | 42.5 | 0 | 50 | 50 | 85 | 74.2 | 0.0 | 96.0 | 113 | 28104 |
| 7 | 8.93 | 42.5 | 33.57 | 11 | 50 | 85 | 47.2 | 33.6 | 57.4 | 70 | 12000 |

As may be seen from above Table 4 comparing Run #1 and Run #2, when the oxygen and inert gas are reduced by 50% as in Run #2, the oil recovery is nevertheless the same as in Run 1, providing that the inert gas is CO2. This means that the gas compression costs are cut in half in Run #2, while oil is produced faster.

As may further be seen from above Table 4, Run #1 having 17.85 molar % of oxygen and 67.15% nitrogen injected into the injection well, estimated oil recovery rate was 41 $m^3$/day. In comparison, using a similar 17.85 molar % oxygen injection with 67.15 molar % carbon dioxide as used in Run #4, a 3.3 times increase in oil production (136 $m^3$/day) is estimated as being achieved.

As may be further seen from Table 4 above, when equal amounts of oxygen and CO2 are injected as in Run #6, still with a total injected volume of 85,000 $m^3$/day, oil recovery was increased 2.7-fold.

Run #7 shows the benefit of adding $CO_2$ to air as the injectant gas. Compared with Run #1, oil recovery was increased 1.7-fold without increasing compression costs. The benefit of this option is that oxygen separation equipment is not needed.

Referring now to FIG. 3, which is a graph showing a plot of oil production rate versus $CO_2$ rate in the produced gas (drawing on Example 7 above), there is a strong correlation between these parameters for in situ combustion processes. $CO_2$ production rate depends upon two $CO_2$ sources: the injected CO2 and the $CO_2$ produced in the reservoir from coke combustion, so there is a strong synergy between $CO_2$ flooding and in situ combustion even in reservoirs with immobile oils, which is the present case.

SUMMARY

For a fixed amount of steam injection, the average daily oil recovery rate increased with air injection rate. This is not unexpected, since the volume of the sweeping fluid is increased. However, it is surprising that the total oil recovered decreases as air rate is increased. This is during the life of the air injection period (time for the combustion front to reach the heel of the horizontal well). Moreover, with carbon dioxide injected in the vertical well, and/or in the horizontal production well, production rates improved production rates can be expected.

Although the disclosure described and illustrates preferred embodiments of the invention, it is to be understood that the invention is not limited to these particular embodiments. Many variations and modifications will now occur to those skilled in the art. For definition of the invention, reference is to be made to the appended claims.

The embodiments of the invention in which an exclusive property or privilege is claimed are defined as follows:

The invention claimed is:

1. A process for extracting liquid hydrocarbons from an underground reservoir, comprising the steps of:

(a) providing at least one injection well for injecting an oxidizing gas into the underground reservoir;

(b) providing at least one production well having a substantially horizontal leg and a substantially vertical production well connected thereto, the horizontal leg having a heel portion in the vicinity of its connection to the vertical production well and a toe portion at the opposite end of the horizontal leg;

(c) injecting an oxidizing gas through the injection well to conduct in situ combustion, so that combustion gases are produced so as to cause the combustion gases to progressively advance laterally as a front, substantially perpendicular to the horizontal leg, and fluids drain into the horizontal leg;

(d) providing a tubing inside the production well within said vertical leg and at least a portion of said horizontal leg for the purpose of injecting a hydrocarbon condensate into said horizontal leg portion of said production well;

(e) injecting a hydrocarbon condensate diluent into said tubing so that said condensate is conveyed into said horizontal leg portion via said tubing; and (f) recovering hydrocarbons in the horizontal leg of the production well from said production well.

2. The process of claim 1, wherein said hydrocarbon condensate diluent is a condensate selected from the group of condensates consisting of ethane, propane, butanes, pentanes, heptanes, hexanes, octanes, and higher molecular weight hydrocarbons, or mixtures thereof.

3. The process of claim 1, wherein said hydrocarbon condensate is a hydrocarbon diluent selected from the group consisting of naphtha or gasoline.

4. The process of claim 1, wherein the injection well is a vertical, slant or horizontal well.

5. The process of claim 1, said step of injecting said hydrocarbon condensate comprising injecting said condensate to a pressure sufficient to pressurize said horizontal well.

6. The process of claim 1 or 5, comprising the step of injecting said hydrocarbon condensate to a pressure sufficient to permit injection of said condensate into the underground reservoir.

7. The process of claim 1, said step of injecting said hydrocarbon condensate comprises injecting said condensate at a temperature and pressure at which said condensate exists in liquid form.

8. The process of claim 1, said step of injecting said hydrocarbon condensate comprises injecting said condensate at a temperature and pressure at which such condensate exists in gaseous form.

9. The process of claim 1, wherein said hydrocarbon condensate is injected into said tubing in combination with a medium selected from the group of mediums consisting of steam, water, or a non-oxidizing gas, or mixtures thereof.

10. The process of claim 1, wherein an open end of the tubing is in the vicinity of the toe of the horizontal section so as to permit delivery of said condensate to said toe.

11. The process of claim 1 or 10, wherein the tubing is partially pulled back or otherwise repositioned for the purpose of altering a point of injection of the condensate along the horizontal leg.

12. The process of claim 1, wherein said condensate is injected continuously or periodically.

13. A process for extracting liquid hydrocarbons from an underground reservoir, comprising the steps of:

(a) providing at least one injection well for injecting an oxidizing gas into an upper part of an underground reservoir;

(b) said at least one injection well further adapted for injecting a hydrocarbon condensate into a lower part of an underground reservoir;

(c) providing at least one production well having a substantially horizontal leg and a substantially vertical production well connected thereto, the horizontal leg having a heel portion in the vicinity of its connection to the vertical production well and a toe portion at the opposite end of the horizontal leg;

(d) injecting an oxidizing gas through the injection well for in situ combustion, so that combustion gases are produced, wherein the combustion gases progressively advance as a front, substantially perpendicular to the horizontal leg, in the direction from the toe portion to the heel portion of the horizontal leg, and fluids drain into the horizontal leg;

(e) injecting a hydrocarbon condensate into said injection well; and (f) recovering hydrocarbons in the horizontal leg of the production well from said production well.

14. The process of claim 13, wherein said hydrocarbon condensate is a condensate selected from the group of condensates consisting of ethane, butanes, pentanes, heptanes, hexanes, octanes, and higher molecular weight hydrocarbons, or mixtures thereof.

15. A method for extracting liquid hydrocarbons from an underground reservoir, comprising the steps of:

(a) providing at least one injection well for injecting an oxidizing gas into an upper part of an underground reservoir;

(b) said at least one injection well further adapted for injecting a hydrocarbon condensate into a lower part of an underground reservoir;

(c) providing at least one production well having a substantially horizontal leg and a substantially vertical production well connected thereto, the horizontal leg having a heel portion in the vicinity of its connection to the vertical production well and a toe portion at the opposite end of the horizontal leg;

(d) providing a tubing inside the production well within said vertical leg and at least a portion of said horizontal leg for the purpose of injecting hydrocarbon condensate into said horizontal leg portion of said production well;

(e) injecting an oxidizing gas through the injection well for in situ combustion, so that combustion gases are produced, wherein the combustion gases progressively advance laterally as a front, substantially perpendicular to the horizontal leg, and fluids drain into the horizontal leg;

(f) injecting a hydrocarbon condensate into said injection well and into said tubing; and (g) recovering hydrocarbons in the horizontal leg of the production well from said production well.

16. The method of claim 15, wherein said hydrocarbon condensate is a condensate selected from the group of condensates consisting of ethane, butanes, pentanes, heptanes, hexanes, octanes, and higher molecular weight hydrocarbons, or mixtures thereof.

17. The method of claim 15, wherein the injection well is a vertical, slant, or horizontal well.

18. The process of claim 1, 13, or 15, wherein:

(i) the substantially horizontal leg portion extends toward said oxidizing gas injection well;

(ii) the toe portion of the horizontal leg portion is closer to the oxidizing gas injection well than the heel portion; and (iii) the combustion front is caused to advance in a direction along the horizontal leg portion from the toe portion to the heel portion.

19. The process of claim 1 or 15, wherein said tubing extends proximate a combustion front formed at a horizontal distance along said horizontal leg portion.

20. The process of claim 1, 13, or 15, wherein:

(i) the substantially horizontal leg portion extends toward said oxidizing gas injection well;

(ii) the toe portion of the horizontal leg portion is closer to the oxidizing gas injection well than the heel portion;

(iii) the combustion front is caused to advance in a direction along the horizontal leg portion from the toe portion to the heel portion; and (iv) said tubing extends, at least initially, to a region proximate said toe portion of said horizontal leg portion so that said condensate is conveyed, at least initially, to said toe portion via said tubing.

* * * * *